United States Patent [19]

Wirtgen

[11] 4,407,605

[45] Oct. 4, 1983

[54] METHOD AND APPARATUS FOR REPAIRING LONGITUDINAL SEAMS OR CRACKS IN ROAD SURFACES

[76] Inventor: Reinhard Wirtgen, D 5461, Windhagen/Linz, Fed. Rep. of Germany

[21] Appl. No.: 273,071

[22] Filed: Jun. 12, 1981

[30] Foreign Application Priority Data

Jun. 16, 1980 [DE] Fed. Rep. of Germany ..... 3022513

[51] Int. Cl.[3] ..... E01C 7/06; E01C 19/05; E01C 3/06

[52] U.S. Cl. ..... 404/77; 404/90; 404/107; 404/92

[58] Field of Search ..... 404/91, 90, 95, 75, 404/77, 92, 107

[56] References Cited

U.S. PATENT DOCUMENTS

| | | | |
|---|---|---|---|
| 2,254,463 | 9/1941 | Wells | 404/95 |
| 2,368,331 | 1/1945 | Seaman | 299/39 X |
| 2,530,777 | 11/1950 | Middlestadt | 404/107 |
| 2,747,475 | 5/1956 | West | 404/95 X |
| 2,965,053 | 12/1960 | Gruber | 404/91 X |
| 3,020,812 | 2/1962 | Gross | 404/107 |
| 3,361,042 | 1/1968 | Cutler | 404/77 |
| 3,407,005 | 10/1968 | Simms | 299/39 |
| 3,606,469 | 9/1971 | Hughes | 299/39 |
| 3,829,161 | 8/1974 | Wirtgen | 299/39 |
| 3,888,542 | 6/1975 | Gowler | 299/39 X |
| 3,970,404 | 7/1976 | Benedetti | 404/77 |

FOREIGN PATENT DOCUMENTS

| | | | |
|---|---|---|---|
| 393454 | 6/1933 | United Kingdom | 404/77 |
| 831392 | 3/1960 | United Kingdom | 404/77 |

*Primary Examiner*—Nile C. Byers, Jr.
*Attorney, Agent, or Firm*—Steinberg & Raskin

[57] ABSTRACT

The invention relates to a method for repairing ruptured longitudinal seams or cracks in road surfaces which consist of a thermoplastic material and particularly of an asphalt coating including bitumen and mineral constituents, by which, under the application of heat, new coating material is applied and consolidated in the area of the longitudinal seams or cracks, wherein at first mud and humidity is removed from, and out of, said longitudinal seam or crack, said longitudinal seam is subsequently softened by heating, said softened coating is loosened from the underground and is compounded with the new material and/or liquid or liquified aggregates and is finally incorporated and consolidated again.

The invention relates also to an apparatus for performing the method, comprising a chassis including its own drive engine and at least one heating device and means for loosening the road coating arranged behind it as seen in the direction of motion, wherein as the means for loosening said road coating a small roller provided with chisels and rotating in a direction opposite to the direction of motion is provided, which roller is arranged in the discharge area of a container holding said new coating material such that when rotating said roller in the discharge area of said container, compounding the old coating material transported up by said chisels and of the new coating material is accomplished.

16 Claims, 4 Drawing Figures

METHOD AND APPARATUS FOR REPAIRING LONGITUDINAL SEAMS OR CRACKS IN ROAD SURFACES

The invention relates to a method for repairing ruptured longitudinal seams or cracks in road surfaces which consist of a thermoplastic material and particularly of an asphalt coating including bitumen and mineral constituents by which, under the application of heat, new coating material is applied and consolidated in the area of the longitudinal seams or cracks.

Particularly in the case of roads having several lanes, the longitudinal seams between two adjacent lanes, under the effects of the weather and/or of heavy traffic, may rupture and thus admit, through these cracks, water and humidity into the road foundation, which might lead to a progressive destruction of the road surface particularly during the cold season. In the asphalt surfaces, too, longitudinal cracks may form because of heavy traffic by which a similar premature wear and damage of the road is promoted.

If and when such ruptured longitudinal seams or longitudinal cracks were repaired at all, this was done by filling them with a preheated filler material or in case of broader cracks or fissures by applying new heated coating material, which was subsequently consolidated with the aid of a hand-operated roller. This way of repairing ruptured seams and cracks in the road surface, however, leaves much to be desired as concerns the stability as well as concerns the surface quality of a road surface so repaired.

In order to repair road surfaces damaged by the influence of the weather and/or by heavy traffic, methods have been known wherein as a first step the road surface is milled off or peeled off and after the removal of the milled-off or peeled-off material a new coating is applied. During the course of the milling off or of the peeling off as well as in the course of the application of the new coating, the road surface is generally subjected to a heating by which the milling or peeling is simplified and a better adhesion of the new coating to the underground is obtained. The milled-off or peeled-off material is either transported by trucks to dumping sites or, according to a newer method, is compounded with the new coating material in a relation corresponding to the requirements and this compound is applied onto the milled-off or peeled-off road surface. To this end, the milled-off or peeled-off material is transported by highly sophisticated conveyor means to a container, which is also charged with a new coating material from a truck.

Particularly in the last-described prior art method, the repair costs per road unit may considerably be reduced as compared to any other method. This method, however, is not suited for repairing longitudinal cracks or ruptured longitudinal seams of road surfaces considering that the use of machinery for the repair of only smaller areas, which longitudinal seams and cracks are, would be much too costly and the repair costs per unit of road surface would be too excessive.

It is, therefore, the aim of the invention to provide a method by which the repair of ruptured longitudinal seams or longitudinal cracks in the surface coatings is possible with minimum technical and personal costs. The method should moreover permit the permanent closure of seams and cracks.

In accordance with the invention, this problem is solved by a method wherein as a first step mud and humidity is removed from, and out of, the longitudinal seam or crack, the longitudinal seam is subsequently softened by heating, the softened coating is loosened from the underground and is compounded with the new material and/or liquid or liquified aggregates and is finally incorporated and consolidated again.

By aggregates, minerals such as for instance bitumen, so-called flux oils, light fuels and the like are to be understood, which are suited to improve the quality of the material to be incorporated and to increase the adhesion between the individual particles.

This method, i.e., cleaning, heating, tearing, incorporating the new coating material and/or aggregates and consolidating, permits a permanent repair of longitudinal, ruptured seams or cracks in a small neighborhood thereof, which means that the repair operations may not only be performed rapidly and with little new coating material but also, with a view to the limitation of the operations to a very small area, may be made without substantially impairing the traffic flow. The latter constitutes a particular advantage of the method according to the invention considering that no costly street barricades need be erected and no time and fuel consuming detours have to be made.

Particularly the prior cleaning of the cracks and longitudinal seams down to their base from mud and humidity and the incorporation of the new material into the road coating loosened from the underground and softened, result in a good compounding of the new and the old coatings and the longitudinal cracks are closed permanently and so as to be resistant to major loads from the flowing traffic.

In order to obtain a high cleaning degree in the longitudinal cracks, or longitudinal seams, respectively, which is of decisive importance for a lasting repair, the longitudinal seam or the longitudinal crack, respectively, is most suitably treated with a burning gas-air mixture of high flow velocity. It is advisable in this case to allow the gas-air mixture to pass into the seam, or the crack, respectively, at an oblique angle as otherwise the mud and dust, which is whirled up, is not completely blown out of the seam, or the crack, respectively.

It has furtheron shown to be suitable that the softened coating is loosened not only from the underground but also in itself, which means that the coating should more or less be crumbled so that the new coating material may more easily be applied. It is of particular advantage if during and after the addition of the new coating material the softened and loosened coating is intimately blended for a long time with the new coating material. It has shown that the degree of blending will exert an increased influence on the durability of the repair, that is, with the growing blending degree the life of the coated area repaired will increase.

In accordance with an advantageous embodiment of the invention, the compound of old coating material and of new coating material is subjected to a further heating process prior to consolidation. This step should be employed particularly in such cases when old and new coating materials are heavily blended as in this case both materials will cool down relatively rapidly. The consequence is that particularly in the area of the seam or crack bottom the compounding of the blended coating material with the road surface foundation might be too poor. The latter is particularly the case when dealing with relatively deep seams or cracks.

For the same reason, i.e., aiming at an intimate compounding of the blended coating material in the bottom area of the seam or of the crack, it is advisable to subject the coating compound to preconsolidation prior and/or after the heating process.

In order to improve adhesion, it has furtheron shown to be advantageous to spray the road surface so treated prior to the incorporation of the material with a liquid or liquified aggregate.

A further idea of the invention relates to an apparatus for performing the method according to the invention. This apparatus comprises a prior art chassis including its own drive engine and wheels and/or caterpillar tracks and including at least one heating device and means for loosening the road coating arranged behind it as seen in the direction of motion.

The apparatus according to the invention differs from the prior art devices in that as the means for loosening the road coating, a small roller provided with chisels and rotating in a direction opposite to the direction of motion is provided, which roller is arranged in the discharge area of a container holding the new coating material such that when rotating the roller in the discharge area of the container, compounding of the old coating material transported up by the chisels and of the new coating material is accomplished.

The roller provided with the chisels fulfills two functions; it loosens the road surface in the area of the seam or the crack, and the coating in itself, and on the other hand blends the old, loosened coating with the new coating material. Special devices for blending the new and the old coating materials or devices for transporting the old coating material to such a blending device are, therefore, no longer necessary in the apparatus according to the invention. This is a particular advantage of the apparatus according to the present invention. In accordance with the invention, a container including a dosing device for liquid or liquified aggregates is provided.

In accordance with an advantageous embodiment of the present invention, the dosing device opens in the discharge area of the container receiving the new coating material. In this way, the aggregates reach the correct location in order to be intimately belended with the old and, in given cases, new coating material.

In accordance with a further embodiment of the apparatus according to the invention, the dosing device is additionally connected (if necessary) to a sprayer device covering the whole width of the ruptured surface to be treated. This sprayer device sprays the aggregate(s), i.e., in this case the adhesion-improving substances, into the gap from which the old road coating material has been taken so that the newly incorporated material will substantially better adhere to the residual coating.

Considering that the added aggregates may also include such aggregates, which under normal conditions are solid, the container for the liquid or liquified aggregates is provided, in accordance with a particularly advantageous embodiment of the apparatus according to the present invention, with a corresponding heating device. This heating device may either serve for liquifying the added aggregates or only to maintain the liquid state if they were already added in that state into the container.

In a particularly advantageous embodiment of the apparatus of the invention, the container for the aggregate(s) is wholly or partly provided with a metal sheet mantle through which the combustion gases of the drive engine are conducted.

For dosing the aggregates, any devices common to those versed in the art may be employed. It has, however, shown to be particularly advantageous if the amount of the liquid or liquified aggregates added by the dosing device is controlled depending on the moving speed of the apparatus. In this way, it is safeguarded that equal amounts of the aggregates are added per unit of length of the longitudinal seam repaired so that a thinning of the newly incorporated road surface coating or a thickening thereof is avoided.

In accordance with an advantageous embodiment of the invention, the container for the new coating material passes, at the lower side thereof, over into a tubular extension of rectangular cross section, in which the roller carrying the chisels is rotatably supported. The arrangement of the roller carrying the chisels in the lower portion of the container has the advantage that a particularly intimate blending between the old coating material and the new coating material is obtained.

The blending degree may furtheron be increased in that the chisels are arranged in at least three levels spaced relative to each other and perpendicular to the roller axis, the chisels in one level being staggered relative to those in the adjacent level in the circumferential direction of the roller. By so staggering the chisels, the old and the new coating material is not only moved to and fro in the circumferential direction of the roller but also in the longitudinal direction of the roller, which has an advantageous effect on the blending of the two materials. When employing a roller having three chisel levels, it has proved to be suitable to stagger the chisels of one level relative to those of the adjacent level at about 120° as it has shown that in this case a particularly good blending of old and new materials may be obtained.

Control of the discharged amount of new and old coating material is suitably obtained in that the rear wall of the tubular container extension is height adjustable. By raising, or lowering, repectively, of the wall, the amount to be discharged may be increased or decreased in the desired manner. For the height adjustment of the wall, a screwed spindle is suitably provided which may be supported at the container wall.

In order to obtain an even discharge of the blended coating material from the tubular extension at the rear wall, it is advisable to provide the latter at the outer side thereof with an extension similar to a finishing screed. By using the finishing screed like extension, a certain consolidation of the blended material in itself and in the seam, or the crack, respectively, is additionally obtained. This preconsolidation may moreover be favored in that at least the lower area of the rear wall and, if necessary, the screed-like extension is in operative connection with a heating device. The wall and the screed-like extension pass on the heat fed to them to the blended material, which, therefore, fits particularly well into the crack or the seam down to the crack bottom or the seam bottom, and because of the increased plasticity caused by the heat fill snug into smaller recesses as well.

In order to adjust the loosening depth of the coating to be repaired, the container carrying the chisel roller is height adjustable. This height adjustment may in accordance with an embodiment of the invention be obtained in that the wheel pair of the chassis adjacent the container is height adjustably secured to the chassis. In accordance with another embodiment it may also be that the container is height adjustably secured to the chassis, a solution which is to be preferred over the other one as it is accomplished with less costs. As for the rest, it cannot be excluded that in special cases the wheel pair of the chassis adjacent the container as well as the container are height adjustably secured to the chassis thus permitting a coarse adjustment via the height adjustable wheel pair and a fine adjustment via the height adjustment between container and chassis. In such a case, the height adjustable wheel pair serves also to hold the container with the chisel roller during pure travelling operation, i.e., when it travels from one place of operation to the other, in an inoperable position elevated from the road surface.

The latter may also be achieved in accordance with another embodiment of the invention in that the container with the chisel roller is swivellingly secured to the chassis around an axis parallel to the roller axis. In such a case, a height adjustable wheel pair may be dispensed with unless it is required for the exclusive height adjustment of the container or the adjustment of the loosening depth, respectively. In a particularly preferred embodiment, the container is secured to a holder having at least one lever which holder on its part is untwistably secured relative to a shaft rotatably supported on the chassis. The shaft carrying the holder is suitably substituted by a roller as in that case, because of the substantially higher weight of the roller as compared to a shaft, vibrations and oscillations as will occur during the course of the operation of the chisel roller have a substantial smaller effect on the whole apparatus, the loosening depth and the evenness of the seam or crack repair.

For swivelling the holder with the container, there is most suitably provided on the chassis a preferably pneumatic or hydraulic positioning device the moving element of which is in operative connection with the lever.

In order to get the apparatus by a minimum of switching maneuvers, and thus as rapidly as possible, into the position necessary for the repair of a longitudinal seam or a longitudinal crack, the container together with the chisel roller is most suitably cross adjustably arranged on the chassis. The apparatus need then only be brought into a position parallel to the longitudinal seam to be repaired or to the longitudinal crack to be repaired rather than into a position exactly above the seam or the crack, respectively, which would entail substantially more maneuvering. The exact adjustment of the roller, which carries the chisel, and of the container is then obtained by cross adjustment thereof relative to the chassis of the apparatus.

For the cross adjustment of the container with the chisel roller relative to the chassis, there is most suitably provided a closed prismatic guide, one portion of which is secured to the container while the other portion thereof is secured to the chassis. The adjustment is advantageously made with the aid of a rack-and-pinion gear where the rack is connected to the container and the pinion engaging with the rack is arranged on a shaft provided with a crank.

In order to obtain an even loosening depth over the whole roller length relative to the road coating surface, there is provided in accordance with an advantageous embodiment, on the two side walls of the tubular container extension one skid each on which the container glides on the road surface during the loosening operation. For the same reason it is advisable to provide booms on the container arranged transverse to the direction of motion to the end of which booms height adjustable skids are secured. For the height adjustment of the skids, screwed spindles may be provided, which are arranged in corresponding threaded bushings and the free ends of which are provided with a crank each.

In accordance with a preferred embodiment of the invention, a first heating device is provided in the front area while a second heating device is provided between the two wheel pairs of the chassis. By this arrangement, a particularly compact structure of the apparatus may be obtained. As the heating device, infra-red radiators have shown to be suitable while other electric or gas-operated heating devices may be employed as well.

In front of the first heating device, there are provided, in accordance with a further development of the above mentioned embodiment, liquid gas operated burners for removing mud and humidity from the longitudinal seam to be repaired or the longitudinal crack to be required. In order to obtain an optimum cleaning effect, at least two to three burner rows are arranged one behind the other in the direction of motion. The first heating device and the burners are suitably combined to constitute one structural unit, which is swivellingly secured to the chassis. This makes possible to swing up the heating device burner unit during travelling operation, i.e., when the apparatus is transported from one location to another, and thus render the apparatus better maneuverable than would be the case with the heating device-burners unit down.

In order to obtain a particularly smooth and steady repair of a ruptured longitudinal seam or longitudinal crack, a third heating device is provided, in accordance with a further development of the invention, behind the container in the direction of motion. By this heating device, the compound consisting of old and new coating material filled into the seam or the crack and already preconsolidated is heated again in its surface area shortly prior to the final consolidation, which may be made by a common road roller. The consequence is that in addition to the above mentioned advantages, the consolidation in the surface area of the coating compound applied is particularly strong, which has a favorable effect on the abrasive resistance of the road surface repaired.

The heating device is advantageously provided on skids and is removably coupled to the container. It may thus in a simple way, for instance, if it is not needed in case of small crack or seam depths, be decoupled and suspended at a suitable location on the apparatus.

The invention will now be explained in more detail based on the drawing which includes, partly in a schematic representation, exemplified embodiments.

Figure 1:
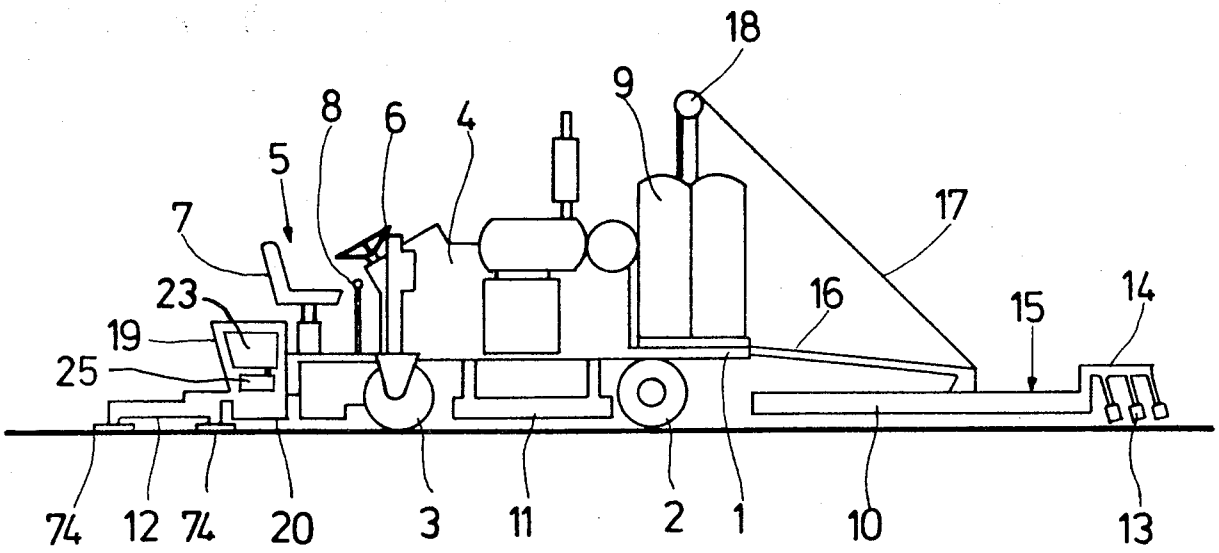
FIG. 1 shows a lateral view of a complete apparatus according to the invention.

The apparatus comprises a chassis 1 including a steerable front wheel pair 2 and a rear wheel pair 3 height adjustably secured to chassis 1. Between the front wheel pair 2 and the rear wheel pair 3, there is provided, on chassis 1, the drive engine 4, at the rear end whereof the driver's stand 5 including the steering wheel 6, the driver's seat 7 and various operation levers 8 are arranged.

In the front portion of chassis 1, there are four liquid gas containers 9, only two of which are shown, for feeding a first heating device 10, a second heating device 11 arranged between wheel pairs 2 and 3 and a third heating device 12, which is arranged behind chassis 1. The liquid gas from containers 9 operates furtheron a number of burners 13, which are arranged in three rows one after the other at the front end of heating device 10. Burners 13 are provided in a holder 14 integral with heating element 10 to constitute a constructional unit 15. Constructional unit 15 is secured to an arm 16, which is hinged at its other end to chassis 1. By means of a traction rope 17, which engages with the end of the arm 16 at the side of the constructional unit and is in connection via a guide pulley 18 with a worm gear secured to the chassis, constructional unit 15 may be drawn into a somewhat vertical position to enable pure travelling motion. On the other hand, the ground clearance of construction unit 15 may be adjusted by the traction rope 17 as well.

Figure 2:
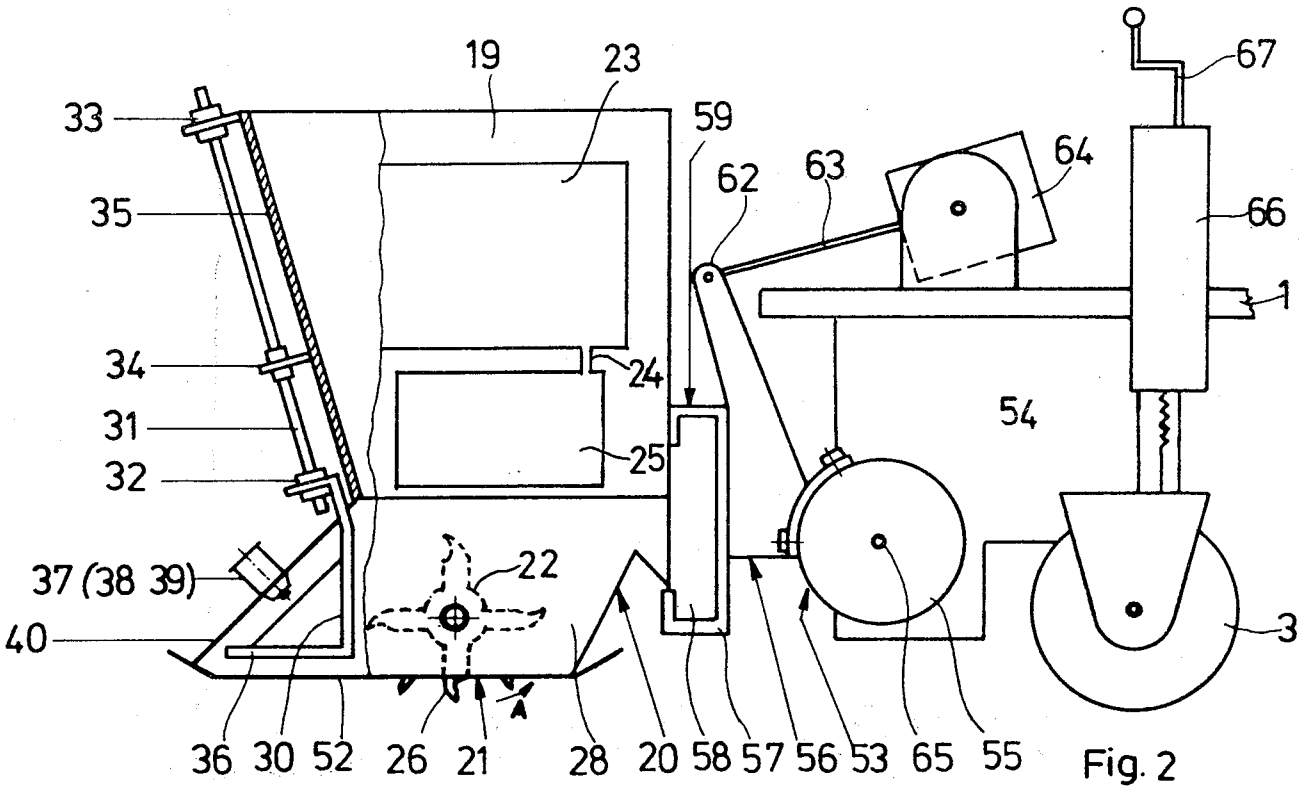
FIG. 2 shows a lateral view of a container including a chisel roller of the apparatus according to FIG. 1.
Figure 3:
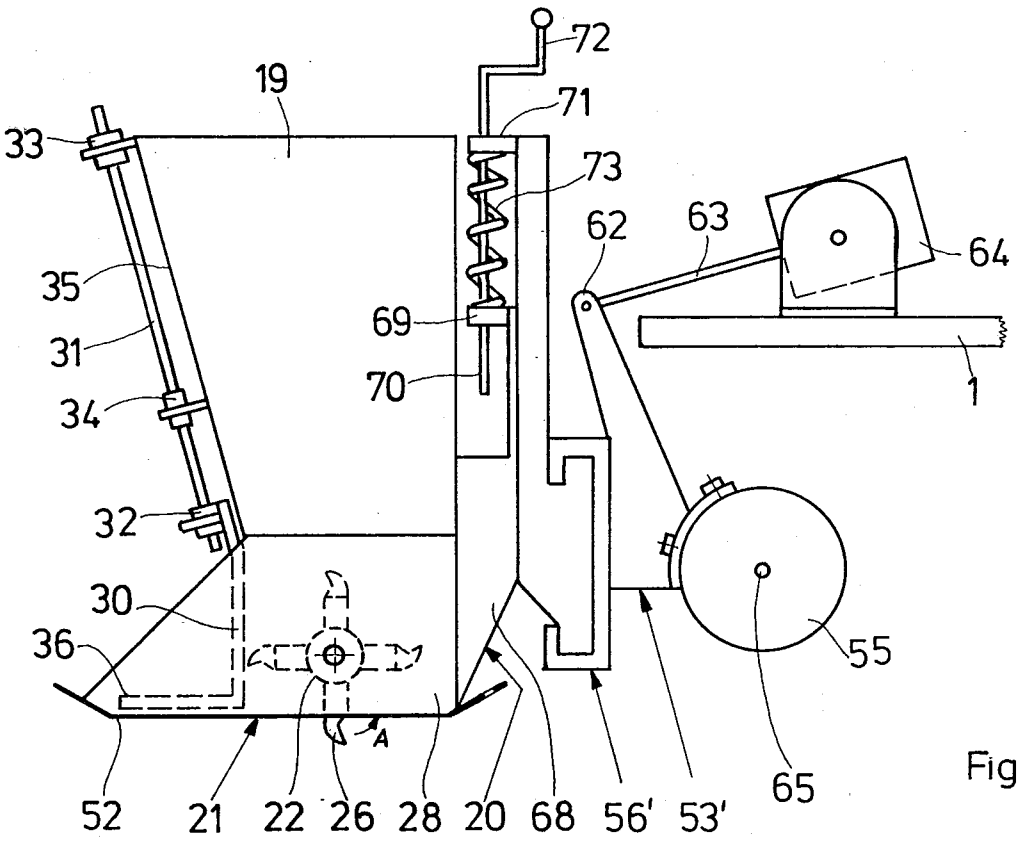
FIG. 3 shows another container including a chisel roller, which is height-adjustably secured to a holder swivellingly provided on the chassis.

Behind the driver's stand 5, container 19 is provided, which, as can particularly be seen in FIGS. 2 and 3, at the lower side thereof passes over into a tubular extension 20 of rectangular cross section, in which a device for loosening the road surface is arranged.

Loosening device 21 comprises roller 22 (FIG. 2) on which chisels 26 are removably secured. Roller 22 is supported in the two side walls 27 and 28 of container 19. To the side wall 27 not shown, drive engine 29 for roller 22 is secured. Engine 29 drives the roller into the direction of arrow A, i.e., opposite to the direction of motion of the apparatus.

On the side wall 28 of container 19, an additional container 23 for liquid or liquified aggregates is moreover provided. This container 23 is connected, via duct 24, to dosing device 25, by which defined amounts of the aggregates may be added in the discharge area of container 19.

Figure 4:
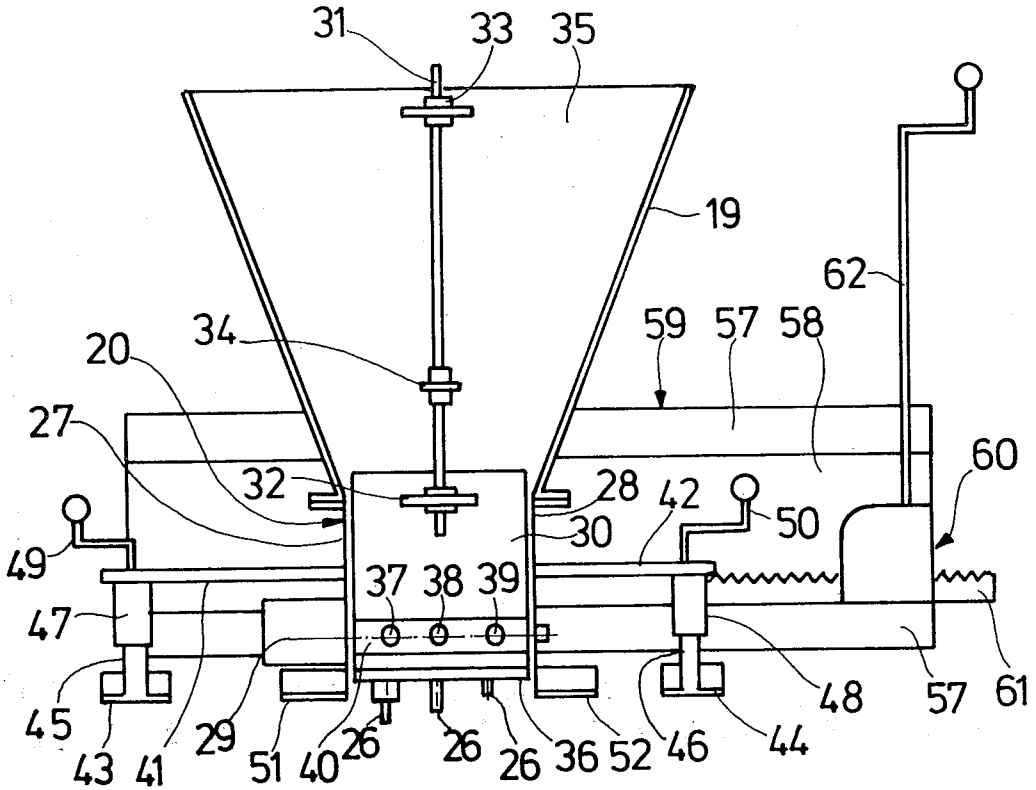
FIG. 4 shows a rear view to the container of the apparatus according to FIG. 1.

As can particularly be taken from FIGS. 2 and 4, rear wall 30 of tubular extension 20 is height adjustable by means of a screwed spindle 31. Screwed spindle 31 engages with its one end with a corresponding threaded nut 32 secured to wall 30, and is supported with its other end in a bushing 33. Bushing 33 as well as further bushing 34 is secured to the rear wall 35 of container 19.

The height adjustable wall 30 of the tubular container extension 20 is provided at its lower end with a finishing screed 36. For heating this finishing screed 36 and the rear wall 30, three burners 37, 38 and 39 are provided, which are arranged in a holder 40, which on its part is secured between the two side walls 27 and 28 of the tubular extension 20. The connecting pipes for the burners 37, 38 and 39 are not shown for the sake of clarity of the representation.

To the two side walls 27 and 28 of the tubular extension 20, two booms 41 and 42 are furtheron secured to the free ends of which one skid 43, or 44, respectively, each is height adjustably secured. For height adjusting skids 43 and 44, each of the two skids is connected to a screw spindle 45, or 46, respectively, including a corresponding threaded nut 47, or 48, 49, or 50, respectively, each at the free ends thereof. Two further skids 51 and 52 are provided immediately at the ends of walls 27 and 28 adjacent the road surface. For the sake of clarity, the booms 41 and 42 with the skids 43 and 44 are not shown in FIG. 3.

Container 19 including loosening device 21 is provided, as can be seen in FIGS. 2 and 4, via a holder 53 on chassis 1. Holder 53 comprises a roller 55, which is supported in two side walls 54, to the periphery of which holder 56 is screwed. Holder 56 includes a guide 57 constituting together with a guide body 58 a prismatic guide 59, by which container 19 including loosening device 21 may be shifted at a right angle relative to chassis 1. Adjustment is brought about by means of a rack-and-pinion gear assembly 60, the rack 61 of which is rigidly secured to container 19 while the pinion of which is indirectly or directlyconnected to a crank 62.

Holder 56 includes furtheron a lever 62, which engages with the movable portion 63 of a pneumatic operating cylinder 64 provided on chassis 1. By operating this operating cylinder 64, container 19 including loosening device 21 may be lowered around axis 65 from an elevated rest position into an operating position and elevated therefrom again.

As already mentioned, adjustment of the loosening depth is achieved in accordance with FIGS. 1, 2 and 4 via height adjustable rear wheel pair 3. For the height adjustment of the two rear wheels 3, two rack-and-pinion gears 66 each are provided operated by means of crank 67. The inclination of container 19 in the direction of motion observed in case of greater height adjustments is regulated by correspondingly actuating hydraulic cylinder 64. In this way, it is safeguarded that skids 52 rest on the road surface over the whole length thereof while the rear wheel pair 3 may be in any height position.

In FIG. 2, the heating device provided for container 23 is not shown for the sake of clarity. This heating device may comprise correspondingly arranged gas burners, which act upon the outer wall of container 23. Other heating means may of course be applied as well.

A further possible height adjustment of container 19 relative to chassis 1 and hence adjustment of the loosening depth is seen in that container 19 including loosening device 21 is height adjustably applied to holder 53'. Such an embodiment is shown in FIG. 3. Container 19 is secured to an intermediate holder 68, which forms together with holder 56' a skid guide. On the intermediate holder 68, there is an extension 69 having a threaded bore passed by a threaded spindle 70, which on its part is supported in a leg 71. At the end opposite extension 69, the threaded spindle includes a crank 72. Between leg 71 and extension 69 pressure spring 73 is provided, which absorbs the vibrations and shocks transmitted from the loosening device 21 to the container 19 and hence to the intermediate holder 68.

Before commencing with the repair of a longitudinal crack in a road surface, the constructional unit 15 comprising burners 13 and the heating device 10 is lowered in the direction of the road, and subsequently, by correspondingly height adjusting the two rear wheels 3 and simultaneously tilting lever 62 by means of pneumatic operating cylinder 64, the desired loosening depth is adjusted. Care should in this connection be taken that the skids are aligned in parallel relative to the road surface and that they rest completely on the road. By actuating screwed spindle 31, the height of wall 30 and of the finishing screed is adjusted. This adjustment depends inter alia on the depth of the crack to be repaired. Particularly in the case of a deep crack, the heating device 12 resting on skids 74 should finally be coupled to container 19. The various heating devices having been put into operation, the repair work can begin. The gas-air mixture ejected under high pressure by the burners will clean the crack and remove any humidity in it.

Subsequently, the crack itself and the immediate neighboring regions is heated by heating device 10 and subsequently by heating device 11. The heated area of the crack is subsequently loosened by the chisels 26 provided on roller 22 and the loosened particles are additionally crushed by the chisels. Together with the loosening and crushing of the old road coating, admixing of new coating material from container 19 is accomplished. The old and new coating material intimately blended by chisels 26 is subsequently pressed via polishing screed 36 into the broadened crack, is preconsolidated and polished. Subsequently, the surface areas of the coating material in the crack is heated again and immediately thereafter the coating material is subjected to a final consolidation by means of a common road roller.

In another embodiment according to FIG. 3, loosening device 21 is directly swivellingly secured via guide organ 58, prismatic guide 59, holder 56 and roller 55 (see FIG. 2) and height-adjustably via wheels 3 to the chassis.

In relation to this loosening device 19, the container 21 is height-adjustable by screwed spindle 70, and pressure spring 73 provides that the container gliding on the ground may evade any unevenness of the ground, but on the other hand will always glide on the ground and thus limit the blending space for the crushed old coating material and the new coating material irrespective of which loosening depth is desired.

I claim:

1. A method for patching longitudinal seams or longitudinal cracks which define substantially longitudinal gaps in road surfaces formed of bituminous material or similar road surface material, comprising the steps of: removing dirt and moisture from within the gap to clean the same by applying heat along the length of the gap; softening the road surface within the cleaned longitudinal gap and in the region of the gap by applying a second heating along the length thereof; loosening the softened road surface from the underlying road substrate; mixing the loosened and softened road surface with a new road surface material to form a road surface material compound; depositing the road surface material compound onto the road in the region from which the softened road surface was loosened; and compacting the deposited road surface material compound.

2. Apparatus for performing the method according to claim 1 comprising a chassis having a drive engine mounted thereon and wheels or the like, at least one heating device mounted on the chassis for heating the road surface in a longitudinal gap and region surrounding the same, and means mounted on the chassis behind said at least one heating device relative to the direction of motion of the chassis over the road for loosening the road surface heated by said at least one heating device, said means for loosening said road surface comprising a small roller provided with chisels adapted to rotate in a direction opposite to the direction of motion, which roller is arranged in a discharge area of a first container adapted to hold new road surface material such that when rotating said roller in the discharge area of said container, the existing road surface material is loosened and transported up by said chisels into said container and mixed with the new road surface material to form a road surface material compound.

3. Apparatus according to claim 1, wherein a second container including a dosing device for liquid and liquified additives is mounted on said chassis.

4. Apparatus according to claim 3, wherein said dosing device opens in the discharge area of said first container.

5. Apparatus according to claim 3, wherein said dosing device is connected to a sprayer device extending over substantially the entire width of the road surface to be treated.

6. Apparatus according to claim 3, wherein said second container for the liquid or liquified additives is provided with a heating device for heating the additives.

7. Apparatus according to claim 3, further including means for controlling the amount of the liquid or liquified aggregates dispensed by said dosing device in a manner determined by the travelling speed of the apparatus.

8. Apparatus according to claim 2, wherein said first container at the lower side thereof includes a tubular extension having a substantially rectangular cross section, said roller carrying the chiseis being rotatably mounted in said tubular extension.

9. Apparatus according to claim 8, wherein said tubular extension of said first container includes a rear wall movably mounted so as to be height-adjustable, said rear wall including an extension positioned to function as a finishing screed.

10. Apparatus according to claim 9, wherein at least a lower region of said rear wall is in operative connection with a heating device.

11. Apparatus according to claim 10, wherein said container is secured to said chassis by means for permitting the height of said first container to be adjusted.

12. Apparatus according to claim 9, wherein a pair of wheels of the chassis proximate to said first container are secured to said chassis so as to be height-adjustable whereby the height of said first container is adustable.

13. Apparatus according to claim 8, wherein said tubular container extension includes a pair of side walls, and wherein at least one skid is provided on each side wall.

14. Apparatus according to claim 2, wherein liquid gas operated burners are arranged in front of said at least one heating device for removing dirt and moisture from within the gap.

15. The method of claim 1 wherein subsequent to said mixing step and prior to said compacting step, subjecting the road surface material compound to an additional heating.

16. The method of claim 1 or claim 15 wherein said mixing step includes improving the adhesion of the components of the loosened and softened road surface and of the new road surface material forming the road surface material compound by spraying the components with additives in liquid form prior to depositing the road surface material onto the road.

* * * * *